US010539126B2

(12) United States Patent
Doi et al.

(10) Patent No.: US 10,539,126 B2
(45) Date of Patent: Jan. 21, 2020

(54) ACOUSTIC FILTER FOR COMPRESSOR

(71) Applicant: Whirlpool S.A., Sao Paulo (BR)

(72) Inventors: Ricardo Mikio Doi, Joinville (BR); Sergio Koerich Lohn, Florianopolis (BR)

(73) Assignee: Embraco—Industria De Compressores E Solucoes EM Refrigeracao Ltda., Joinville (BR)

( * ) Notice: Subject to any disclaimer, the term of this patent is extended or adjusted under 35 U.S.C. 154(b) by 312 days.

(21) Appl. No.: 15/620,937

(22) Filed: Jun. 13, 2017

(65) Prior Publication Data

US 2017/0356433 A1 Dec. 14, 2017

(30) Foreign Application Priority Data

Jun. 14, 2016 (BR) ..... 102016013787

(51) Int. Cl.
*F04B 39/00* (2006.01)
*F04B 39/16* (2006.01)
*F04B 39/12* (2006.01)

(52) U.S. Cl.
CPC ..... *F04B 39/0072* (2013.01); *F04B 39/0061* (2013.01); *F04B 39/16* (2013.01); *F04B 39/123* (2013.01)

(58) Field of Classification Search
CPC ..... F04B 39/0072; F04B 39/0055; F04B 39/0061; F04B 39/0066
USPC ..... 181/229; 417/312
See application file for complete search history.

(56) References Cited

U.S. PATENT DOCUMENTS 5,734,134 A * 3/1998 Park ..... F02M 35/1255 181/229
5,804,777 A * 9/1998 Kim ..... F02F 7/006 181/229
5,971,720 A * 10/1999 Fagotti ..... F04B 39/0055 181/403
6,206,135 B1 3/2001 Kim et al. ..... 181/229
6,358,019 B1 * 3/2002 Iversen ..... F04B 39/0072 181/403
6,415,888 B2 * 7/2002 An ..... F01N 1/12 181/229
6,446,454 B1 * 9/2002 Lee ..... F04B 39/0061 181/403
6,692,238 B2 * 2/2004 Myung ..... F04B 39/0061 417/312

(Continued)

*Primary Examiner* — Jeremy A Luks
(74) *Attorney, Agent, or Firm* — Harrington & Smith

(57) ABSTRACT

Reduction of noise produced by hermetic compressors. The acoustic filter includes an inlet duct, an outlet duct and a main chamber. The inlet duct includes a refrigerant fluid inlet and a refrigerant fluid delivery end. The refrigerant fluid delivery end is opposite to the refrigerant fluid inlet and it is capable of guiding the refrigerant fluid to the main chamber. The outlet duct includes a refrigerant fluid outlet and a refrigerant fluid collection end. The refrigerant fluid collection end is opposite to the refrigerant fluid outlet for guiding the refrigerant fluid from the main chamber to the fluid outlet. The filter includes a resonator chamber arranged adjacent to the inlet duct and adjacent to the main chamber. The resonator chamber and the inlet duct are fluidically connected by a resonator tube and the resonator chamber is separated from the main chamber by a sealing wall.

20 Claims, 4 Drawing Sheets

(56) References Cited

U.S. PATENT DOCUMENTS

| | | | | |
|---|---|---|---|---|
| 6,715,582 | B2 * | 4/2004 | Nissen | F04B 39/0061 181/231 |
| 7,052,248 | B2 * | 5/2006 | Yagi | F04B 39/0061 181/229 |
| 8,235,683 | B2 * | 8/2012 | Kinjo | F04B 39/0055 181/403 |
| 8,246,320 | B2 * | 8/2012 | Park | F04B 39/0055 181/229 |
| 8,517,697 | B2 * | 8/2013 | Kinjo | F04B 39/02 181/249 |
| 9,145,879 | B2 * | 9/2015 | Pirovano | F04B 39/0055 |

* cited by examiner

ACOUSTIC FILTER FOR COMPRESSOR

The present invention relates to an acoustic filter for compressors, used in cooling systems of household appliances. The subject matter of the present invention discloses a solution presenting an assembly with greater efficiency in the acoustic/thermodynamic relation compared to the other filters of the state of the art.

BACKGROUND OF THE INVENTION

Clearly, a compressor generates pulses, which in turn generate noise when in operation. Therefore, a number of technical solutions were developed over the years to reduce or even try to eliminate the noise generated. Among said solutions, there is the suction acoustic filter, which can be provided in compressors such as those used in applications for cooling systems of household appliances.

The suction acoustic filter is generally arranged in the compressor between the refrigerant fluid inlet and the valve, so that its inlet receives the refrigerant fluid which has passed through the evaporator and its outlet delivers said fluid to the cylinder, so that it is compressed by the piston.

The acoustic effect of the filter is obtained by the various geometric configurations that said device may have. Thus, according to the geometric configuration chosen or projected, the pulses of the pressures may be attenuated by the effect of passive cancellation.

A common problem for a person skilled in the art is to be able to combine good acoustic performance with good thermodynamic performance. Generally, said two objectives are related inversely proportional, in other words, when a filter has good performance in pulse attenuation, the thermodynamic performance thereof is relatively reduced, and vice versa.

An example that can be obtained from the state of the art is in document U.S. Pat. No. 6,206,135. Said document describes a suction acoustic filter for hermetic compressors endowed with a refrigerant fluid path. From the figures of said document, it is possible to verify that the path has a specific sinuous shape, which connects the refrigerant fluid inlet to the refrigerant fluid outlet. In addition, along said path there are resonance chambers parallel to the flow.

However, although the filter presented by the document U.S. Pat. No. 6,206,135 may achieve the effect of reducing noise, it should be noted that the assembly thereof is complex. Said complexity comes from the fact that said path has an unconventional shape, in other words, it is rather sinuous and narrow in some regions, in addition to the fact that there is more than one resonance chamber. Moreover, the fact that said filter has several inner walls increases the amount of material for its manufacture, which makes this product more expensive. Finally, allied with all said disadvantages, it is important to note that the sinuous and narrow sections have relatively lower thermodynamic performance, as a person skilled in the art must quickly intuit.

As can be observed, in general, it is noted that the state of the art lacks a filter having, simultaneously, a good thermodynamic and acoustic performance.

OBJECTIVES OF THE INVENTION

Therefore, the present invention is basically aimed to solve the problem that the filters of the state of the art do not have, at the same time, good acoustic and thermodynamic performance.

SUMMARY OF THE INVENTION

The objectives of the invention are achieved by means of an acoustic filter comprising an inlet duct, an outlet duct and at least one main chamber. The inlet duct comprises a refrigerant fluid inlet and a refrigerant fluid delivery end, wherein the refrigerant fluid delivery end is opposite to said refrigerant fluid inlet and it is capable of guiding the refrigerant fluid to the main chamber. The outlet duct comprises a refrigerant fluid outlet and a refrigerant fluid collection end, wherein the refrigerant fluid collection end is opposite to said a refrigerant fluid outlet and it is capable of guiding the refrigerant fluid from the main chamber to said fluid outlet. The filter further comprises a resonator chamber arranged adjacent to the inlet duct and adjacent to the main chamber, wherein the resonator chamber and the inlet duct are fluidically connected by means of at least one resonator tube and the resonator chamber is separated from the main chamber by means of a sealing wall.

BRIEF DESCRIPTION OF THE DRAWINGS

The present invention will be described in detail on the basis of the figures listed below, in which.

DETAILED DESCRIPTION OF THE INVENTION

The subject matter of the present invention will be more fully described and explained on the basis of the accompanying drawings, which are of a merely exemplifying and non-limiting character, since adaptations and modifications may be performed without, thereby, escaping from the claimed scope of protection.

Figure 1:
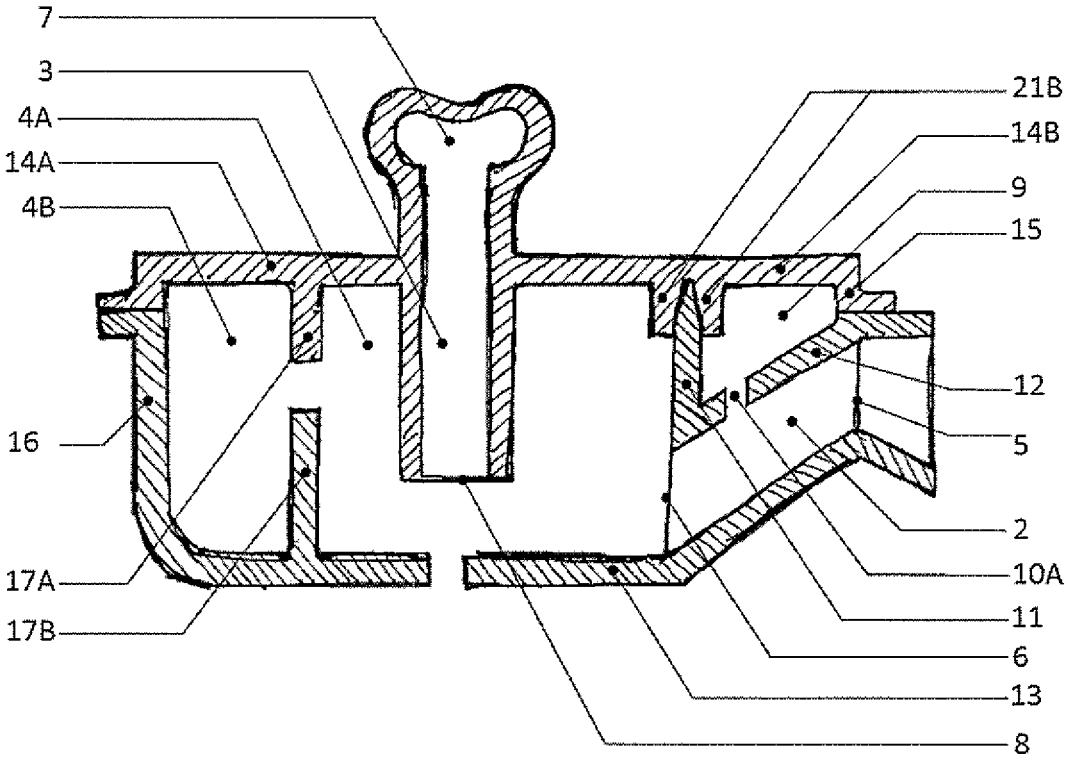
FIG. 1 is a sectional side view of the acoustic filter, according to a first embodiment of the present invention.
Figure 2:
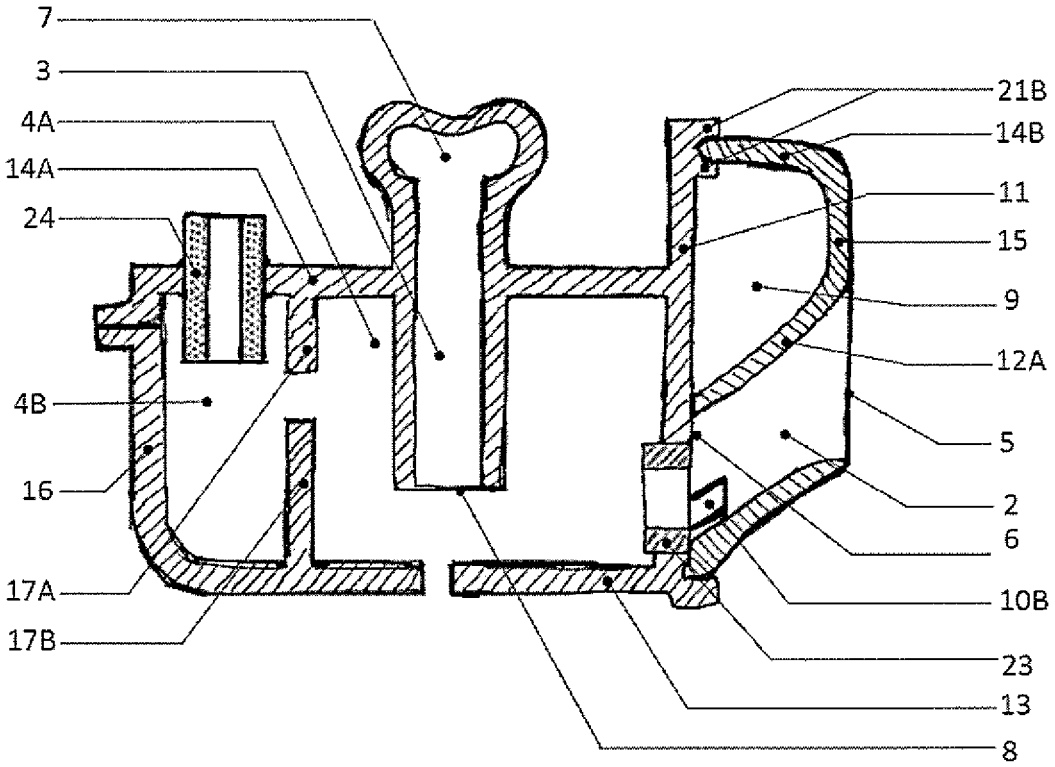
FIG. 2 is a sectional side view of the acoustic filter, according to a second embodiment of the present invention.
Figure 4:
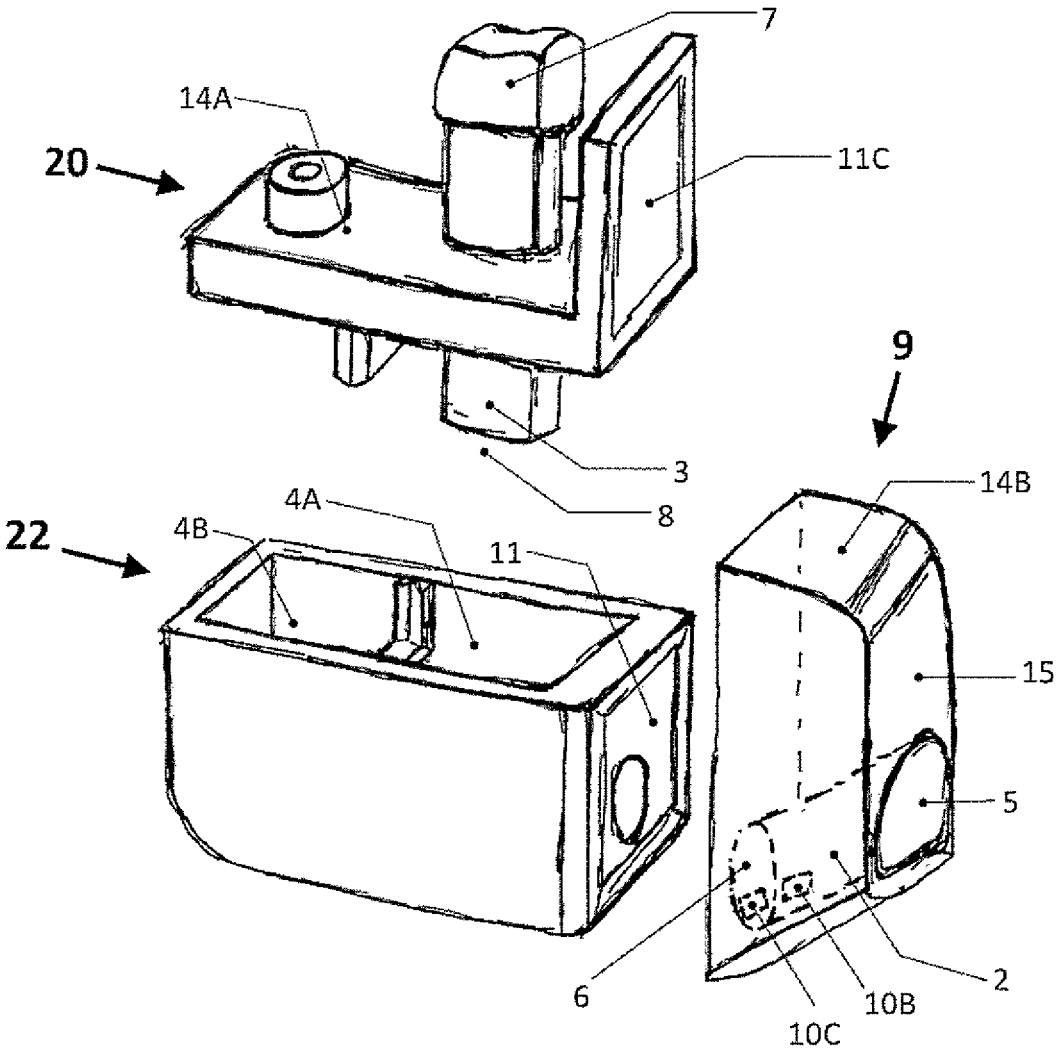
FIG. 4 is a perspective view of the cap, base and resonator chamber separated according to the second embodiment of the invention presented in FIG. 2.

As presented in FIG. 1, the filter of the present invention comprises an inlet duct (2), an outlet duct (3) and a main chamber (4A), in addition to a resonator chamber (9) in a same body. In one of the embodiments of the present invention, such as that illustrated in a exemplifying manner in the figures, the filter of the present invention may comprises a second main chamber (4B) arranged in parallel and fluidically communicating with the first main chamber (4A), wherein between the main chambers (4A and 4B) at least one partition wall (17A, 17B) is arranged. Alternatively, as illustrated in FIGS. 2 and 4, the resonator chamber (9) and the main chamber (4A) may be separate parts which are connected to form the body of the filter.

The inlet duct (2) comprises a refrigerant fluid inlet (5) and a refrigerant fluid delivery end (6) opposite to the said inlet (5). In the exemplifying embodiment of the invention illustrated in the figures, the inlet duct (2) is inclined, wherein the refrigerant fluid inlet (5) is arranged on the side of the filter (1) at a higher position relative to the delivery end (6).

In turn, the outlet duct (3) comprises, at one of its two ends, a refrigerant fluid outlet (7), wherein the other is a refrigerant fluid collection end (8). Thus, from this arrangement, the fluid passes through the inlet duct (2), traverses the delivery end (6), which guides the fluid to the main chamber (4A) and, depending on the embodiment of the present invention, to the second main chamber (4B), to then traverse the collection end (8) towards the outlet (7). In the exemplifying embodiment illustrated in the figures, the outlet duct (3) is vertical.

As can be observed from FIG. 1, the resonator chamber (9) is arranged contiguous to the main chamber (4A), in an adjacent manner, and separated by a sealing wall (11). Further, the resonator chamber (9) is also arranged contiguous to, in an adjacent manner, the inlet duct (2), being fluidically connected to said inlet duct (2) by means of a resonator tube (10A). In the embodiment illustrated FIGS. 1 and 3, the resonator tube (10A) is a hole with diverse topological geometries (circumference, rectangle or ellipse) provided in a side wall (12) of the inlet duct (2) and, more precisely, said hole is arranged in the lower region of the resonator chamber (9), to favor the drainage of any lubricating oil of the compressor accumulated in this region. In an alternative embodiment of the present invention, as illustrated in FIGS. 2 and 4, the resonator chamber (9) completely envelops the inlet duct (2), being fluidically connected to said inlet duct (2) by means of one or two resonator tubes (10B and 10C). Said resonator tubes are also holes provided in two regions of the side of the inlet duct (2) and both holes are also arranged in the lower region of the resonator chamber (9), aiming the drainage of the oil.

More precisely, it is noted that the resonator chamber (9) comprises two side walls (15 and 11), an upper wall (14B), a bottom wall (12A), which is the wall of the inlet duct (3), comprising the at least, in other words, it is a wall shared with the wall of the duct (2), in which it is provided the resonator tube (10A, 10B). Further, one of the side walls (11) is the sealing wall (11).

On the other hand, considering the exemplifying embodiment with two main chambers (4A and 4B), it is noted that they comprise a bottom (13), side walls (11, 16), an upper wall (14A) and, alternatively, at least one partition wall (17A, 17B), wherein one of the side walls is, precisely, the sealing wall (11), which is shared with the resonator chamber (9). Thus, from this arrangement, it is observed that between the end of the sealing wall (11) and the bottom (13) of the main chamber (4A), it is located the delivery end (6) of the inlet duct (2), so that the delivery end is facing the bottom (13) of the main chamber (4A). It is also worth noting that the duct (3) traverses the upper wall (14B) of the main chamber (4A) (and of the second main chamber (4B), depending on the embodiment of the present invention), so that the refrigerant fluid outlet (7) is arranged outside the body of the filter (1) and the collection end (8) is facing the bottom (13) of the main chamber (4A).

As to the shape, it is observed from FIG. 1 that the resonator chamber (9) comprises a substantially trapezoidal section. Evidently, the volume of the resonator chamber (9) may vary depending on the frequencies of the pulses to be attenuated. The same applies to the dimensions of the resonator tube (10A), which may also vary according to the frequency range of interest. As to the main chambers (4A) and (4B), the shapes presented are also merely illustrative, wherein depending on the implementation of the invention, the shapes thereof may vary within the scope of the claims.

Figure 3:
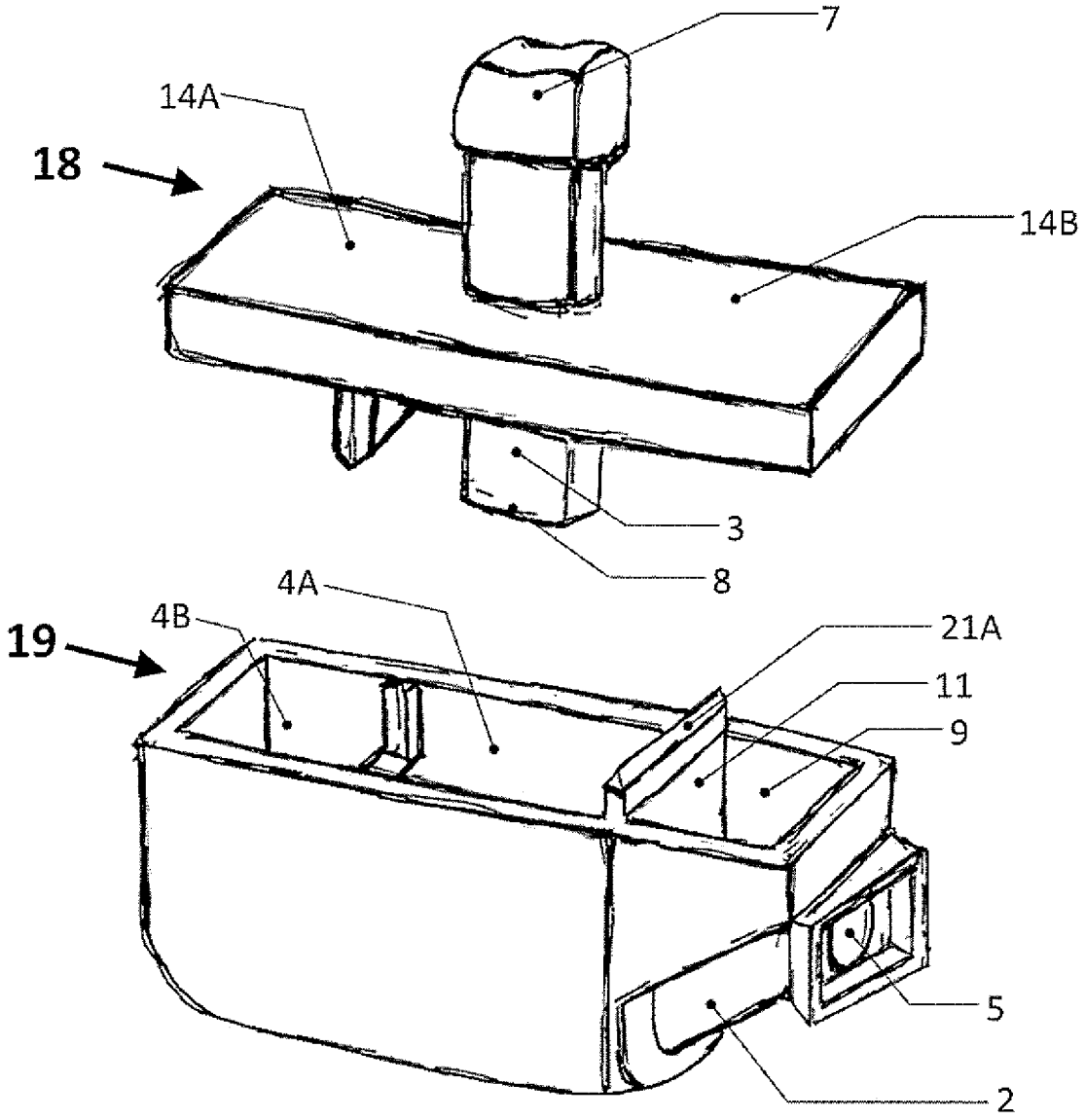
FIG. 3 is a perspective view of the cap and base of the filter separated according to the first embodiment of the invention presented in FIG. 1.

Referring now to FIG. 3, it is possible to observe that the filter (1) is formed by a cap (18) and a base (19) fixable to each other. Said cap (18) is formed in one piece and comprises the outlet duct (3), the refrigerant fluid outlet (7), the collection end (8) and further comprises the upper wall (14A) of the main chambers (4A) and (4B) and the upper wall (14B) of the resonator chamber (9). Alternatively, referring to FIG. 4, it is observed that the filter (1) is formed by a cap (20), a base (22) and the resonator (23), fixable to each other. The cap (20) is also formed in one piece and comprises the outlet duct (3), the refrigerant fluid outlet (7), the collection end (8) and a complementary wall (11C) for fitting in the resonator chamber (9). As already mentioned, the resonator is formed by the resonator chamber (9), upper wall (14B), side wall (15), duct (2), refrigerant fluid inlet (5), fluid delivery end (6) and resonator tubes (10B and 10C). From FIG. 1, it can be seen that the sealing wall (11) and the cap (18, 20) comprise fittings (21A and 21B) co-operating with each other. More precisely, the fittings are a receptacle (21B) and an extension (21A) of the sealing wall (11), such that the receptacle (21B) is arranged in the inferior portion of the cap (18) and it is configured to receive said extension (21A). In the embodiment of the invention illustrated in FIG. 2, the receptacle (21B) is arranged in the complementary wall (110) and it is also configured to receive said extension (21A) arranged in the sealing wall (11). From the FIGS. 3, 4 it can be seen that the sealing wall (11) is in the base (22) and the complementary wall (110) in the resonator chamber (9). The attachment of the cap (20) to the base (22) makes the wall (11C) and the wall (11) coplanar so as to be suitable for receiving the resonator chamber (9). The definitive connection of the resonator chamber (9), with the base (22) and with the cap (20) is achieved by means of ultrasonic welding, glue or adhesive, for example.

Finally, it is worth noting that the filter of the exemplifying embodiment of FIGS. 2 and 4 allows insertion and verification of the isolated operation of additional elements for a suction filter, such as a valve seat (23) in the body of the filter (1) and, more precisely, adjacent to the refrigerant fluid delivery end, and a valve control (24) arranged in the upper wall (14A) of the at least one main chamber (4A, 4B). With said elements, the filter of the second embodiment of the present invention is capable of meeting the acoustic performance required by some particular compressors, such as that described in the Brazilian patent application BR 10 2016 003051 0.

As observed from the assemblies described above, the filter of the present invention has improvements in the acoustic performance versus thermodynamic performance relation. Said improvements are due, for example, to the fact that the assembly of the filters allows ducts with larger diameters (improvement in thermodynamic performance). Furthermore, said feature is combined with the positioning of the resonator chamber (9) adjacent to the inlet duct (2) (improvement in acoustic performance).

In addition to said advantages, it is worth noting that the first exemplifying embodiment of the present invention illustrated in FIGS. 1 and 3 is relatively simpler with respect to the filter of the state of the art. For example, said facility can be easily seen by the fact that the filter of the present invention may be assembled in only two parts, in other words, by the cap (18) and the body (19).

The invention claimed is:

1. Acoustic filter for compressor comprising:

an inlet duct, an outlet duct and at least one main chamber, wherein the inlet duct comprises a refrigerant fluid inlet and a refrigerant fluid delivery end, wherein the refrigerant fluid delivery end is opposite to said refrigerant fluid inlet and it is capable of guiding the refrigerant fluid to the main chamber;

the outlet duct comprises a refrigerant fluid outlet and a refrigerant fluid collection end, wherein the refrigerant fluid collection end is opposite to said a refrigerant fluid outlet and it is capable of guiding the refrigerant fluid from the main chamber to said fluid outlet, the filter being characterized by the fact that it comprises a resonator chamber arranged adjacent to the inlet duct and adjacent to the main chamber, wherein the resonator chamber and the inlet duct are fluidically connected by at least one resonator tube and the resonator chamber is separated from the main chamber by a sealing wall;

wherein the resonator tube is at least one hole provided in a side wall of the inlet duct provided in the lower region of the resonator chamber; and wherein the resonator chamber comprises a bottom wall, side walls and upper wall, wherein the bottom wall shared with the inlet duct and one of the side walls is the sealing wall.

2. Filter, according to claim 1, characterized by the fact that the resonator chamber and the main chamber are arranged in the same body of the filter.

3. Filter, according to claim 1, characterized by the fact that the resonator chamber and the at least one main chamber are separate parts which are connected to form the body of the filter.

4. Filter, according to claim 1, characterized by the fact that the resonator tubes are at least two holes provided in two regions of the side of the inlet duct provided in the lower region of the resonator chamber.

5. Acoustic filter for compressor, according to claim 1, characterized by the fact that the bottom wall is the wall of the inlet duct which comprises the resonator tube.

6. Filter, according to claim 1, characterized by the fact that the at least one main chamber comprises a bottom, side walls and an upper wall, wherein one of the side walls is the sealing wall, wherein between the end of the sealing wall and the bottom of the main chamber the delivery end of the inlet duct is arranged.

7. Filter, according to claim 6, characterized by the fact that the refrigerant fluid inlet is arranged on the side of the filter and the delivery end faces the bottom of the main chamber.

8. Filter, according to claim 6, characterized by the fact that the outlet duct traverses the upper wall of the main chamber, wherein the refrigerant fluid outlet is arranged outside the body of the filter and the collection end faces the bottom of the main chamber.

9. Filter, according to claim 1, characterized by the fact that the inlet duct is inclined and the outlet duct is vertical.

10. Filter, according to claim 1, characterized by the fact that it is formed by a cap and a base fixable to each other.

11. Filter, according to claim 1, characterized by the fact that it is formed by a cap, a base and the resonator fixable to each other.

12. Filter, according to claim 10, characterized by the fact that the cap is formed in one piece and comprises the outlet duct, the refrigerant fluid outlet, the collection end and further comprises the upper wall of at least one main chamber and the upper wall of the resonator chamber.

13. Filter, according to claim 11, characterized by the fact that the cap is formed in one piece and comprises the outlet duct, the refrigerant fluid outlet and the collection end and a complementary wall for fitting in the resonator chamber.

14. Filter, according to claim 1, characterized by the fact that a cap is formed in one piece and comprises the outlet duct, the refrigerant fluid outlet, the collection end and further comprises the upper wall of at least one main chamber and the upper wall of the resonator chamber, and that the sealing wall and the cap comprise fittings co-operating with each other, wherein the fittings comprise an extension of the sealing wall and a receptacle arranged in the cap configured to receive said extension.

15. Filter, according to claim 1, characterized by the fact that a cap is formed in one piece and comprises the outlet duct, the refrigerant fluid outlet, the collection end and further comprises the upper wall of at least one main chamber and the upper wall of the resonator chamber, and that the sealing wall and the cap comprise fittings co-operating with each other, wherein the fittings comprise an extension of the sealing wall and a receptacle arranged in a complementary wall configured to receive said extension.

16. Filter, according to claim 1, characterized by the fact that it further comprises a second main chamber arranged in parallel and fluidically communicating with the first main chamber, wherein between the main chambers at least one partition wall is arranged.

17. Acoustic filter for compressor comprising:

an inlet duct, an outlet duct and at least one main chamber, wherein the inlet duct comprises a refrigerant fluid inlet and a refrigerant fluid delivery end, wherein the refrigerant fluid delivery end is opposite to said refrigerant fluid inlet and it is capable of guiding the refrigerant fluid to the main chamber;

the outlet duct comprises a refrigerant fluid outlet and a refrigerant fluid collection end, wherein the refrigerant fluid collection end is opposite to said a refrigerant fluid outlet and it is capable of guiding the refrigerant fluid from the main chamber to said fluid outlet, the filter being characterized by the fact that it comprises a resonator chamber arranged adjacent to the inlet duct and adjacent to the main chamber, wherein the resonator chamber and the inlet duct are fluidically connected by at least one resonator tube and the resonator chamber is separated from the main chamber by a sealing wall;

wherein the at least one main chamber comprises a bottom, side walls, and an upper wall, wherein one of the side walls is the sealing wall, wherein between the end of the sealing wall and the bottom of the main chamber the delivery end of the inlet duct is arranged, and that it further comprises a valve seat arranged adjacent to the refrigerant fluid delivery end and a valve control arranged in the upper wall of the at least one upper wall of the main chamber.

18. Filter, according to claim 17, wherein the refrigerant fluid inlet is arranged on the side of the filter and the delivery end faces the bottom of the main chamber.

19. Filter, according to claim 17, wherein the outlet duct traverses the upper wall of the main chamber, wherein the refrigerant fluid outlet is arranged outside the body of the filter and the collection end faces the bottom of the main chamber.

20. Filter, according to claim 17, further comprising a second main chamber arranged in parallel and fluidically communicating with the main chamber, wherein between the main chamber and the second main chamber at least one partition wall is arranged.

* * * * *